United States Patent [19]

Thompson

[11] Patent Number: 4,606,418

[45] Date of Patent: Aug. 19, 1986

[54] CUTTING MEANS FOR DRAG DRILL BITS

[75] Inventor: Charles M. Thompson, Coppell, Tex.

[73] Assignee: Reed Tool Company, Houston, Tex.

[21] Appl. No.: 759,459

[22] Filed: Jul. 26, 1985

[51] Int. Cl.[4] ..... E21B 10/56; E21B 10/60

[52] U.S. Cl. ..... 175/329; 175/339; 175/409; 175/410

[58] Field of Search ..... 175/329, 330, 339, 340, 175/393, 410, 415, 418, 422; 299/81

[56] References Cited

U.S. PATENT DOCUMENTS

| | | | |
|---|---|---|---|
| 1,388,490 | 8/1921 | Suman | 175/393 |
| 4,303,136 | 12/1981 | Ball | 175/393 |
| 4,334,585 | 6/1982 | Upton | 175/393 |
| 4,452,324 | 6/1984 | Jürgens | 175/393 |
| 4,494,618 | 1/1985 | Radtke | 175/393 |
| 4,498,549 | 2/1985 | Jürgens | 175/329 |

*Primary Examiner*—James A. Leppink
*Assistant Examiner*—Terry Lee Melius
*Attorney, Agent, or Firm*—Vinson & Elkins

[57] ABSTRACT

A rotary drill bit (10) having a plurality of diamond cutting elements (48) each having a cutting face (60) with a discharge nozzle (64) therein. The discharge nozzle (64) directs the flow of drilling fluid away from the cutting face (60) and is surrounded by the cutting face (60).

18 Claims, 7 Drawing Figures

CUTTING MEANS FOR DRAG DRILL BITS

BACKGROUND OF THE INVENTION

This invention relates generally to drag type drill bits and more particularly to improved cooling and cleaning means for cutting elements on a drag type drill bit.

The two main problems encountered in drilling which tend to deteriorate bits or to result in decreased penetration of a formation, are deterioration of the bit face resulting from heat degradation, and "balling". Balling is caused by a sticky formation, such as sticky shales or similar formations having a large percentage of clays, adhering to the cutting face of the bit. This may occur in certain formations, for example, where the hydraulic action of the drilling mud is inadequate or where hydraulic passages in the bit may be poorly designed which result in an inefficient cross-flow of mud across the face of the bit. It is noted that for drilling offshore the continental United States, water base muds are normally employed as government regulations generally render the use of oil base muds cost prohibitive. The use of water base muds results in a substantial balling, particularly when drilling in sticky shales or similar formations. One reason for this effect is believed to be the swelling effect of the water on the clays of the shale material as the drag-type drill bits have cutting elements which are prone to clogging or balling up.

It has become common to provide drag-type rotary drill bits with cutting elements projecting from the outer bit surface made of polycrystalline (man-made) diamond compacts or cutters ("PDC") on inserts or studs secured within openings in the bit body. A drag-type bit actually cuts or chips the earth formation instead of crushing the formation as in a normal cone-type roller drill bit. The use of diamond in cutting elements is especially important in drag-type bits in order to increase their life. The polycrystalline diamond material typically is provided in the form of a relatively thin layer of around 0.020 inch, for example, on one face of a disc formed of tungsten carbide. The disc is normally secured, such as by brazing, to the body of a stud to form an insert which fits within a bore or recess in the body of the drag type drill bit.

The disc with the diamond face and tungsten carbide base which may be around one-eighth (⅛) inch in thickness, for example, as well known in the art, is manufactured by the Specialty Material Department of General Electric Company at Worthington, Ohio and sold under the trademark "Stratapax". A series of inserts are normally secured within openings in the face of the drag bit body in an interference fit or by brazing. However, inserts other than diamond studded inserts may be provided, such as, for example, tungsten carbide inserts.

It is highly desirable that means be provided to cool and clean each of the bit inserts while they are working in the bore hole. As shown in U.S. Pat. No. 4,303,136 dated Dec. 1, 1981, each diamond or stud insert in a diamond drag bit has an individual flow passage therefor in front of the diamond cutting face of the insert, thereby to assure cooling and cleaning of each insert in the face of the drag bit. The drilling fluid discharged from the fluid passageway directs the hydraulic mud around the synthetic diamond cutting face of the stud body.

Further, as shown in U.S. Pat. No. 4,452,324 dated June 5, 1984, discharge nozzles are shown for cutting faces in a rotary drill bit. However, it has been common and accepted practice to direct the jet or stream of drilling fluid from the nozzles toward the cutting faces as it has been felt that by directing the fluid toward the cutting face an improved cleaning action is effected. One result of such a jet or stream of drilling fluid toward the cutting face is that the cuttings are directed by the jet toward the outermost portion of the cutting edge adjacent the formation, which is believed to reduce the cutting efficiency of the cutting face as cuttings might be wedged by a negative rake of the cutting face against the formation to be cut.

SUMMARY OF THE INVENTION

The present invention relates to a drag type drill bit having a plurality of cutting elements with each cutting element having a cutting face in a generally annular shape surrounding or encircling a discharge port or nozzle for the drilling fluid so that the drilling fluid is discharged in a stream adjacent the cutting face, but directed away from the cutting face, thereby to obtain a highly effective cooling and cleaning action for each cutting face. The drill bit has a bit body with a main fluid passage therein and is adapted to be connected to a drill string for rotation therewith and in the drill string to receive drilling fluid therefrom. The bit body has an outer surface with a plurality of spaced openings therein in fluid communication with the main fluid passage in the drill string to receive drilling fluid therefrom, and a plurality of outwardly projecting cutting elements are secured within the openings. Each cutting element has an outer cutting face with a fluid discharge port or nozzle therein in fluid communication with the associated opening in the bit body to receive drilling fluid therefrom for discharge into the formation to be cut. The discharge port is surrounded or encircled by the cutting face and provides drilling fluid for discharge in a direction away from the cutting face to cool and clean the associated cutting element during the cutting operation. The cooling drilling fluid, by being surrounded by the cutting face, is in a unique location to provide a highly effective cooling and cleaning effect to the cutting face. With the cutting face being in contact with or directly adjacent the formation, the flow of drilling fluid out the discharge port effects a washing action by the drilling fluid over the surface of the cutting face during the drilling operation.

Each cutting element has its own associated nozzle or discharge port and a maximum cleaning action is effected which is particularly desirable when drilling in sticky shales or the like in which the cutting elements are prone to clogging or balling up. With the drilling fluid being forced to pass through discharge nozzles or discharge ports in the face of the cutting element which surrounds such ports, an improved hydraulic design has resulted which has been found to be a substantial improvement, particularly when drilling with water-based drilling muds in sticky shales or the like in which the water effects a swelling of certain types of clays in such formations.

It is an object of the present invention to provide in a drag type drill bit an improved means to cool and clean each of the cutting elements projecting from the outer surface of the drill bit.

A further object of this invention is to provide in such a drag type drill bit an improved flow of drilling fluid directly adjacent the cutting face of a cutting element with drilling fluid being discharged in a stream directed away from the cutting face thereby to effect a highly effective cooling and cleaning action by the drilling fluid in a wash action over the surface of the cutting face which surrounds the discharge nozzle or discharge port.

Other objects, features, and advantages of this invention will become more apparent after referring to the following specification and drawings.

DESCRIPTION OF THE INVENTION

Figure 1:
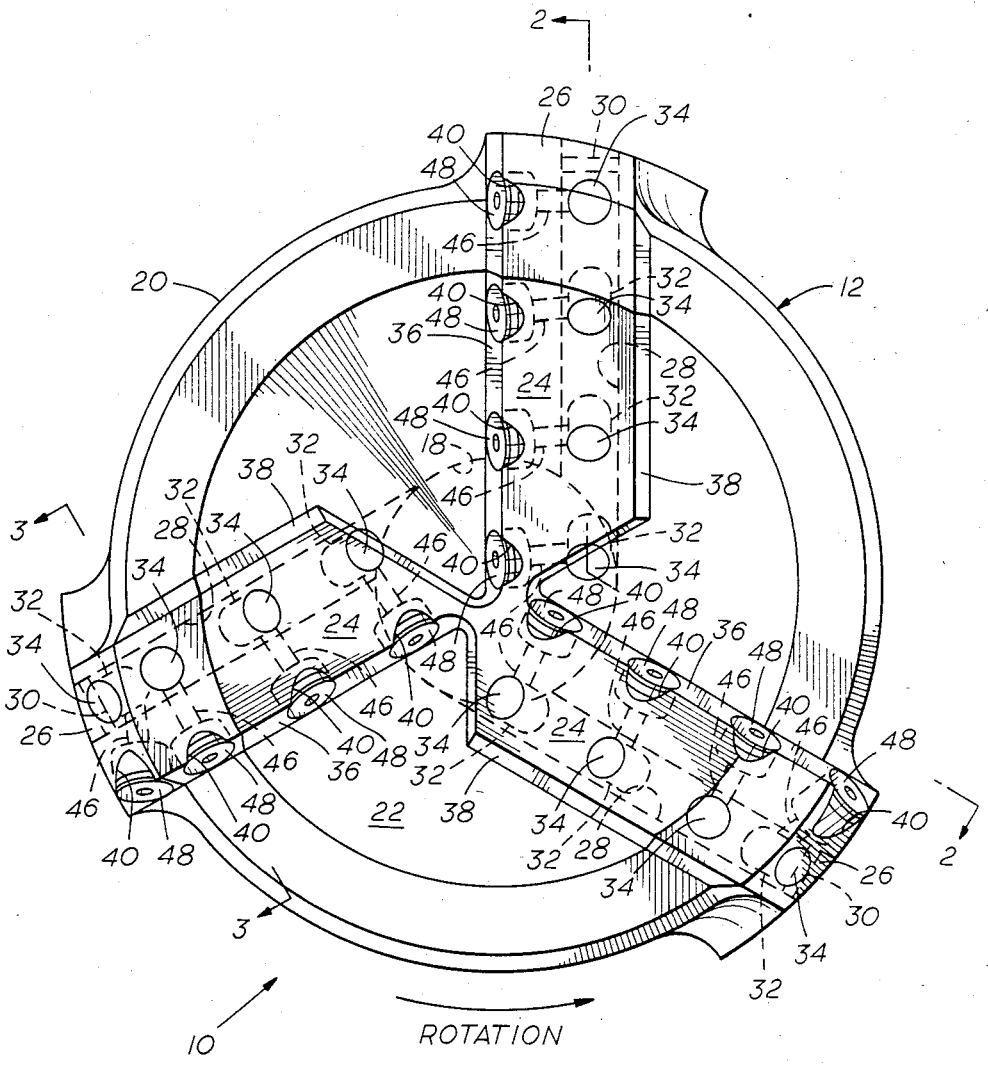
FIG. 1 is a bottom plan of the drag drill bit forming this invention and illustrating the cutting elements projecting from the outer surface thereof.
Figure 2:
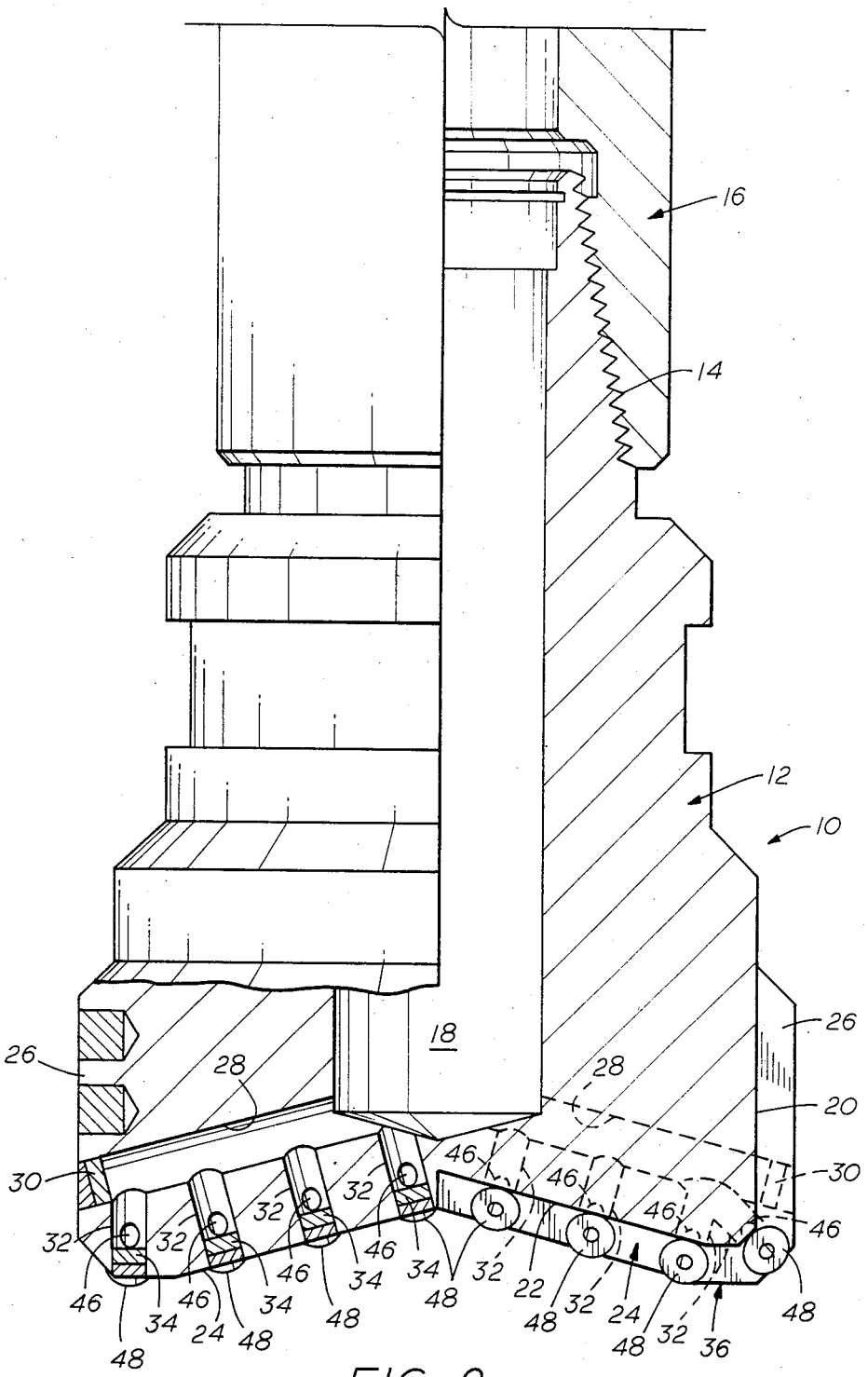
FIG. 2 is a section taken generally along line 2—2 of FIG. 1 but showing the drill bit partly in side elevation.

Referring particularly to FIGS. 1 and 2, a drag type rotary drill bit is shown generally at 10 having a generally cylindrical bit body 12 with an externally threaded pin 14 at its upper end. Pin 14 is threaded within the lower end of a drill string indicated generally at 16 which is suspended from a drill rig at the surface for rotating drill bit 10. Drill bit body 12 has a longitudinally extending main flow or fluid passage 18 which is adapted to receive drilling fluid or mud from the drill rig for the drilling operation. Bit body 12 has an outer peripheral surface 20 and a lower face 22 forming a suitable crown. Projecting from lower surface 22 are a plurality of extensions or ribs 24 which have side portions 26 extending along outer peripheral surface 20 to form the outer gage for bit body 12. It is to be understood that bit body 12 can be formed with various types of crown designs for the face of the bit body depending, for example, on such factors as the type of formation, or the mud program proposed for the formation. Bit body 12 may be formed of any suitable material, such as various types of steels, or cast tungsten carbide.

A branch flow or fluid passage 28 is provided for each rib 24 and is in fluid communication with main flow passage 18 to receive drilling fluid therefrom. An end plug 30 is provided to close the end of each branch flow passage 28 which has been drilled through bit body 12. A plurality of supplemental or connecting fluid passages 32 extend from each branch flow passage 28 toward the outer surface of drill bit 12. The outer ends of the connecting flow passages 32 are plugged with a suitable plug indicated at 34.

Figure 3:
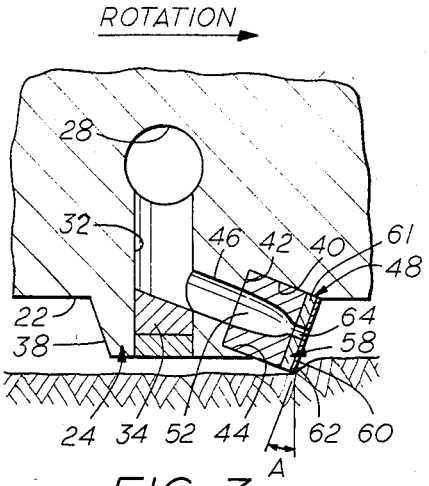
FIG. 3 is an enlarged section taken generally along line 3—3 of FIG. 1 and illustrating a cutting element positioned within an opening in the drill bit with fluid passages providing drilling fluid for the discharge port or nozzle in the cutting element.
Figure 4:
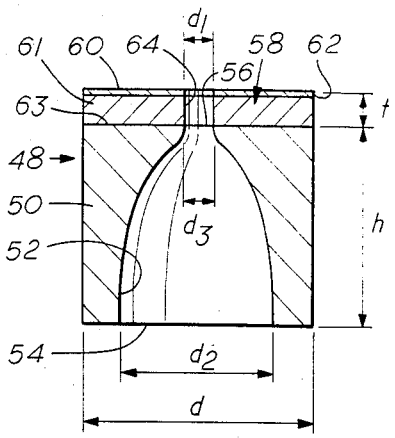
FIG. 4 is an enlarged section of the cutting element removed from the drill bit of FIG. 3.
Figure 5:
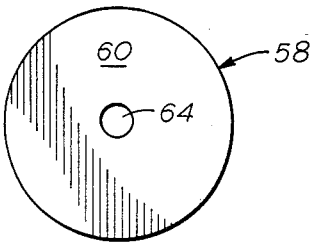
FIG. 5 is a plan of the cutting element shown in FIG. 4.

Referring particularly to FIGS. 3–5, rib 24 has a leading side 36 and a trailing side 38 with respect to the direction of rotation as shown by the arrows in FIGS. 1 and 3. A plurality of spaced openings 40 are provided in leading edge 36. Openings 40 define an annular shoulder 42 and an inner peripheral surface 44. A discharge port 46 connects opening 40 with connecting fluid passage 32 for the flow of drilling mud or fluid therethrough from main flow passage 18. Secured within each opening 40 is a cutting element or insert generally designated 48. Insert 48 may be secured within opening 40 by any suitable means, such as an interference fit or by brazing, for example. Cutting insert 48 includes a stud body 50 formed preferably of a hardened tungsten carbide material, for example, and has a tapered central bore therethrough indicated generally at 52 in fluid communication with discharge port 46. Bore 52 tapers from a large diameter end 54 to a small diameter end 56 as shown in FIG. 4. Secured to the outer end of stud body 50 is a disc generally designated 58 having an outer thin diamond layer defining a cutting face or planar surface 60 and a cutting edge 62. Disc 58 has a tungsten carbide base 61 suitably secured to the end of stud body 50, such as, for example, by brazing at 63. While face 60 is preferably formed of a polycrystalline (man-made) diamond material, it may be formed from other materials, such as, for example, natural diamond or tungsten carbide.

Formed centrally in disc 58 is a discharge port or nozzle 64 communicating with port 52 to receive drilling fluid or mud therefrom. Disc 58 is thus of a generally annular shape encircling or surrounding discharge port or nozzle 64. Discharge port 64 is normally of a smaller diameter than discharge port 52 in stud body 50 so that a high velocity jet or stream of drilling fluid is discharged outwardly from face 60 of disc 58 in a direction away from the planar surface or face 60. The discharged drilling fluid will wash the cuttings away from the face 60 about the entire circumference of face 60 to clean and cool the face, thereby prolonging the life and providing a more effective cutting action for cutting insert 48.

As an example of a specific insert 48 which has been found to function effectively, reference is made to FIG. 4 in which insert 48 has a diameter d of 0.530 inch. Disc 58 has a thickness t of around 0.020 inch and body 50 has a height h of 0.30 inch. The diameter d1 of opening 64 is 3/16th inch. Diameter d2 of end 54 is 0.25 inch and diameter d3 of end 52 is 0.20 inch. In order to maintain an effective cooling and cleaning action across the face of face 60, it is desirable that opening 64 be formed of certain minimum and maximum dimensions. It has been found that opening 64 may vary from around 1/16th inch in diameter to a maximum of around ½ inch in diameter. Opening 64 preferably comprises a minimum area around ten (10) percent of the total area circumscribed by planar surface 60 of disc 58, and a maximum area of around fifty (50) percent of the total area circumscribed by planar surface 60.

As shown in FIG. 3, it is desirable that disc 58 have a negative rake or be inclined as shown in FIG. 3 with respect to the rotation of drill bit 10. A negative angle A is illustrated in FIG. 3 and is preferably around twenty (20) degrees. It is believed that a negative rake of between around five (5) degrees and around thirty-five (35) degrees would function adequately for a polycrystalline diamond face or a natural diamond face.

Figure 6:
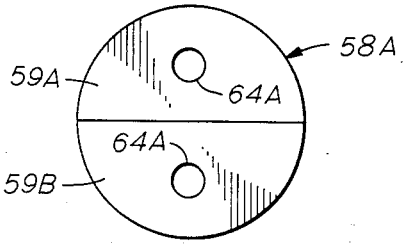
FIG. 6 is a plan of a modified cutting element shown in a pair of semicircular segments.
Figure 7:
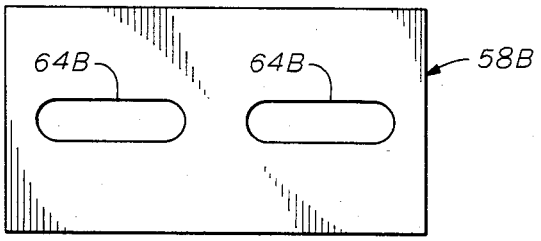
FIG. 7 is a plan of a further modification of a cutting element having a generally rectangular planar surface with a pair of oval discharge ports therein.

While cutting face 60 has been illustrated as being circular in shape and formed of a single type of material, it is apparent that other shapes or composite materials may be employed effectively. For example, referring to FIG. 6, disc face 58A is shown separated into two generally semicircular segments 59A and 59B each having a discharge port 64A. Segment 59A is formed of tungsten carbide and segment 59B is formed of diamond. FIG. 7 shows a generally rectangular disc 58B with oval discharge ports or nozzles 64B illustrated. It is apparent that other various types of shapes could be employed to carry out the present invention in which the cutting face surrounds the discharge opening or nozzle and thereby provides a highly effective washing action across the entire face of the cutting disc for cutting and cleaning purposes.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

I claim:

1. A rotary drill bit of the drag type comprising:

a generally cylindrical bit body having a fluid passage therein and adapted to be connected to a drill string for rotation therewith and to receive drilling fluid therefrom, said bit body having an outer surface with a plurality of spaced openings therein in fluid communication with said fluid passage to receive drilling fluid therefrom; and a plurality of cutting elements comprising stud inserts received within said openings, each cutting element projecting outwardly from said outer surface and having an outer planar cutting face with a negative rake between around five degrees and thirty-five degrees for contacting in cutting relation a formation to be cut;

at least a substantial number of said cutting elements each having a fluid discharge port therein in fluid communication with an associated opening in the bit body to receive drilling fluid therefrom for discharge, said fluid discharge port extending through at least a portion of said planar cutting face and directing drilling fluid in a stream generally perpendicular to the plane of said planar cutting face and toward the formation to be cut.

2. A rotary drill bit as set forth in claim 1 wherein each stud insert has a central bore therethrough in fluid communication with the discharge port in said cutting face.

3. A rotary drill bit as set forth in claim 1 wherein said stud inserts each includes a body formed of tungsten carbide and said face is formed of polycrystalline diamond.

4. A rotary drill bit as set forth in claim 1 wherein said bit body has a main flow passage extending longitudinally thereof, and a plurality of connecting flow passages extend generally laterally outwardly from said main flow passage to said spaced openings to provide fluid communication between said main flow passage and said spaced openings for providing drilling fluid to said fluid discharge ports.

5. A rotary drill bit of the drag type comprising:

a bit body having a fluid passage therein and adapted to be connected to a drill string for rotation therewith and to receive drilling fluid therefrom; and a plurality of cutting elements secured to said bit body, each cutting element having a carbide stud projecting outwardly from the outer surface of the bit body and a PDC disc on the extending end of the stud, said PDC disc having an outer planar PDC cutting face thereon with a negative rake between around five degrees and thirty-five degrees for contacting in cutting relation a formation to be cut;

each cutting element having a fluid discharge port extending through said stud and through said planar cutting face for directing drilling fluid in the direction of rotation of the drill bit generally perpendicular to the plane of said planar cutting face, said discharge port being surrounded by said planar face and in fluid communication with said fluid passage to receive drilling fluid therefrom for discharge in a high velocity stream directly into the formation to be cut.

6. A rotary drill bit as set forth in claim 5 wherein said cutting face is generally circular and said discharge port is generally circular.

7. A rotary drill bit as set forth in claim 5 wherein said cutting face is a generally rectangular planar face.

8. A rotary drill bit as set forth in claim 7 wherein said discharge port is generally oval in shape.

9. A rotary drill bit as set forth in claim 5 wherein said bit body has a main flow passage extending longitudinally thereof and a plurality of branch flow passages extend generally laterally outwardly from said main flow passage; and a plurality of connecting flow passages extend between each branch flow passage and associated fluid discharge ports of the cutting faces to provide drilling fluid thereto.

10. A rotary drill bit as set forth in claim 9 wherein each cutting element comprises a stud insert fitted within an associated opening in the outer surface of said bit body, each stud insert having a central bore therethrough in fluid communication with the discharge port in an associated cutting face.

11. A rotary drill bit as set forth in claim 5 wherein said fluid discharge port has a total area of between around 10% to 50% of the total area circumscribed by the outer periphery of the associated cutting face surrounding said discharge port.

12. A rotary drill bit as set forth in claim 5 wherein said fluid discharge port has a minimum width of around 1/16th inch and a maximum width of around ½ inch.

13. A rotary drill bit as set forth in claim 5 wherein said cutting face has a negative rake of between around five degrees (5°) and thirty-five degrees (35°).

14. A drag drill bit comprising:

a bit body having a lower face with a plurality of spaced ribs projecting from said lower face, each rib having a plurality of spaced openings therein;

a plurality of cutting elements secured within said spaced openings and projecting outwardly from the associated rib, each cutting element having an outer cutting face and a fluid discharge nozzle therein; said fluid discharge nozzle being surrounded by said cutting face and having a total area between around ten percent (10%) and fifty percent (50%) of the total area circumscribed by the outer periphery of the associated cutting face;

said bit body having a main fluid passage therein and said ribs each having a branch fluid passage therein for providing drilling fluid to the discharge nozzles in said cutting faces.

15. A drag drill bit as set forth in claim 14 wherein each cutting element includes a stud insert fitted within an associated opening in said ribs, each stud insert having a central bore therethrough in fluid communication with the associated discharge nozzle and the associated branch fluid passage.

16. A rotary drill bit of the drag type comprising:

a bit body having a fluid passage therein and adapted to be connected to a drill string to receive drilling fluid therefrom and for rotation; and a plurality of cutting elements secured to said bit body and projecting outwardly from the outer surface of the bit body, each cutting element having a disc including a outer planar PDC cutting face with a negative rake at least around five degrees (5°);

each outer planar PDC cutting face having a fluid discharge port therein in fluid communication with said fluid passage to receive drilling fluid therefrom for discharge in a high velocity stream perpendicular to the plane of said planar cutting face and toward the formation to be cut, said discharge port being at least partially surrounded by said PDC cutting face.

17. A rotary drill bit as set forth in claim 16 wherein said fluid discharge port has a minimum width of around 1/16 inch and a maximum width of around ½ inch.

18. A rotary drill bit of the drag type comprising:

a bit body having a fluid passage therein and adapted to be connected to a drill string to receive drilling fluid therefrom and for rotation; and a plurality of cutting elements secured to said bit body and projecting outwardly from the outer surface of the bit body, each cutting element having an outer cutting face for contacting in cutting relation a formation to be cut;

each cutting face having a fluid discharge port therein in fluid communication with said fluid passage to receive drilling fluid therefrom for discharge in a high velocity stream into the formation to be cut, said fluid discharge port being at least partially surrounded by said cutting face and directing drilling fluid away from said cutting face during the cutting operation, said cutting face comprising a pair of semicircular segments formed of different materials with each segment having a fluid discharge port therein.

* * * * *